US006755115B2

(12) United States Patent
Stoll et al.

(10) Patent No.: US 6,755,115 B2
(45) Date of Patent: Jun. 29, 2004

(54) WORKING CYLINDER

(75) Inventors: Kurt Stoll, Esslingen (DE); Alfredo Hofmann, Rutesheim (DE); Manfred Moritz, Plochingen (DE)

(73) Assignee: Festo AG & Co., Esslingen (DE)

( * ) Notice: Subject to any disclaimer, the term of this patent is extended or adjusted under 35 U.S.C. 154(b) by 0 days.

(21) Appl. No.: 10/240,899

(22) PCT Filed: Feb. 22, 2001

(86) PCT No.: PCT/EP01/01996

§ 371 (c)(1),
(2), (4) Date: Oct. 4, 2002

(87) PCT Pub. No.: WO02/068828

PCT Pub. Date: Sep. 6, 2002

(65) Prior Publication Data

US 2003/0047065 A1 Mar. 13, 2003

(51) Int. Cl.[7] ..... F15B 9/09
(52) U.S. Cl. ..... 91/363 R; 92/177
(58) Field of Search ..... 91/361, 363 R; 92/177, 165 PR

(56) References Cited

FOREIGN PATENT DOCUMENTS

| | | | |
|---|---|---|---|
| DE | 3524414 | A1 | 10/1986 |
| DE | 29818075 | U1 | 2/1999 |
| DE | 1000396 | A1 | 9/2000 |
| EP | 0713980 | A2 | 5/1996 |
| EP | 0824196 | A1 | 2/1998 |
| EP | 0930130 | A2 | 7/1999 |

OTHER PUBLICATIONS

"Ratio–Drive: Eine elektrohydraulische Komplettlösung", Olhydraulik und Pneumatik, Krausskopf Verlag Fur Wirtschaft GMBH. Mainz, DE, Bd. 43, Nr. 11/12, Nov. 1999, Seite 843, XP000859958, ISSN: 0341–2660.

*Primary Examiner*—Edward K. Look
*Assistant Examiner*—Michael Leslie
(74) *Attorney, Agent, or Firm*—Hoffmann & Baron, LLP

(57) ABSTRACT

A fluid power operated fluid power cylinder having a cylinder housing (2) on whose rear side a control system housing (33) is mounted. The control system housing (33) contains a valve means and furthermore a electronic valve circuitry and/or electronic control circuitry as control components for the operation of the fluid power cylinder. Externally on the control system housing (33) electrical connection means (63) are provided for the supply of electrical control signals and fluid connection means (48) for the supply of the operating fluid.

23 Claims, 2 Drawing Sheets

WORKING CYLINDER

FIELD OF THE INVENTION

The invention relates to a power cylinder operated by fluid power and more especially a pneumatic cylinder.

BACKGROUND OF THE INVENTION

Fluid power cylinders generally have an elongated cylinder housing in which a piston is arranged able to be moved by fluid actuation and which is connected with a piston rod extending at the front end of the cylinder housing.

In the case of the fluid power cylinder disclosed in the European patent publication 0 713 980 A2 control components are arranged in the cylinder housing and cooperate for the control of the fluid actuation of the piston. These control components comprise electronic control circuitry attached in an anchoring groove and valves accommodated in recesses in the cover of the cylinder housing.

SUMMARY OF THE INVENTION

One object of the present invention is to provide a fluid power cylinder of the type initially mentioned which despite its directly having control components for the actuation nevertheless possesses compact dimensions.

In order to attain this object a fluid power cylinder and more particularly a power pneumatic cylinder, is provided comprising:

- a cylinder housing containing therein a piston receiving space in which a piston able to be moved by fluid actuation is arranged, which is kinematically coupled with a piston rod extending out at the front end of the cylinder housing,
- a control system housing mounted on the rear end of the cylinder housing, which system housing contains control components cooperating for control of fluid actuation of the piston, such control components including an electrically actuated valve means and furthermore electronic valve circuitry and/or electronic control circuitry cooperating in the electrical control of the valve means,
- electrical connection means provided externally on the control system housing for the supply of electrical control signals, which electrical connection means are connected in the control housing with the electronic valve circuitry and/or electronic control circuitry,
- fluid connection means provided externally on the control system housing for the supply of an actuating fluid, which electrical connection means are connected with the valve means, whence control ducts emerge, which extend in the wall of the cylinder housing to the piston receiving space.

The fluid power cylinder of the invention may be designed with an extremely slim shape, since the relevant control components are placed in a rear extension of the cylinder housing. It is more especially possible to so select the configuration of the control system housing that its external form does not extend past the outline of the axially adjoining cylinder housing. It is furthermore relevant here that the valve means and the electronic valve circuitry and/or electronic control circuitry employed for its electrical control are accommodated safely in a further housing mounted to the rear on the cylinder housing, which further housing is termed the control system housing. It is thus possible to ensure that the relevant components are arranged close together at the same position, something which substantially facilitates manipulation of part during connection and/or servicing operations. The supply of the actuating fluid takes place by way of the fluid connection means provided on the control system housing, the supply of fluid to the piston receiving space taking place by way of fluid ducts termed control ducts integrated in the cylinder housing so that no loose fluid lines have to be installed on the periphery of the cylinder housing.

Further advantageous developments of the invention are defined in the dependent claims.

More particularly when the control system housing and the cylinder housing possess an at least generally identical outer form it is an advantage for a rectangular outline to be selected and more particularly one with a square shape. The fluid power cylinder may then be extremely simply installed and if necessary readily connected with other instrumentalities.

In the peripheral part of the piston receiving space it is convenient to provide sensor means, which serve for detecting the position of the piston and which are electrically contacted by means of suitable sensor signal lines or leads, arranged to extend into the control system housing. Here they may be connected with any electronic control circuitry present or connected with the electrical connecting means, by way of which an external control means may be connected.

The control system housing will more particularly possess at least one access opening, which is closed by a housing cover, which when required may be removed in order to permit access to the control components accommodated in the control system housing. The access opening is preferably provided laterally on the control system housing, it also being possible to have several access openings closed by housing covers, such openings being distributed about the periphery of the control system housing. In the case of a rectangularly shaped control system housing it is possible to provide a plurality of access openings on differently aligned side faces of the control system housing.

In the case of a particularly preferred form of the invention a housing cover is designed as a support for electronic valve circuitry and/or electronic control circuitry arranged on the inner side of the housing cover. Here in this case access may be had to the electronic valve circuitry and/or electronic control circuitry in an extremely simple and straightforward manner by doffing the housing cover.

If control system housing has a plurality of access openings distributed at the side around the periphery an arrangement is recommended in the case of which one access opening is opposite to the electrical drive means of the valve arrangement and a further access opening is arranged adjacent to the electronic valve circuitry and/or electronic control circuitry, the latter being more particularly so placed that the electronic circuitry is seated directly on the housing cover. This means that all control components significant for operation may be accessed if required in an extremely simple way.

The control components may comprise simple electronic control means, which for example includes a voltage conversion circuit or other components necessary or advantageous for the actuation of the electrical valve means. The electrical control signals necessary for operation may be supplied by way of electrical connection means, which are able to be connected by way of a cable with external electronic control circuitry. However, it is readily possible to provide electronic control circuitry in the control system housing instead of or in addition to valve control electrical circuitry in the control system housing, which electronic control circuitry preferably comprises a field bus electronic system and offers the possibility of linking the fluid power cylinder by way of a bus with other equipment or of connecting it to external control means. The electronic control circuitry may furthermore be provided itself with a control program, which causes a predetermined operational sequence to be implemented by the fluid power cylinder, when the electronic control circuitry is supplied by way of electrical connection means with external control signals.

In principle it would be feasible to design the control system housing as a body closed on all sides. It is however substantially more advantageous and also better from the point of view of saving space and materials to design the control system housing like a pot having a round or polygonal cross section and to attach it to the open side, which is opposite to the floor, to the fore on the rear side of the cylinder housing. It is in this manner that the cylinder housing will itself constitute the termination of the control system housing.

Furthermore there is the possibility of so accommodating the valve means in the inner space defined by the control system housing that even when the control system housing is mounted it extends between the floor of the pot-like control system housing and the cylinder housing and is secured here as well. It is however also possible to have an interlocking engagement between the above mentioned components, such engagement more particularly serving to produce the duct connections, by way of which the actuating fluid is supplied to the valve member and from which said fluid leaves the valve means.

In the case of a pneumatic fluid power cylinder it is to be recommended to provide all venting openings on the rear side facing away from the cylinder housing, of the control system housing. In this case each venting opening may be provided with a muffler and more particularly with an integrated spent air choke means to set the maximum piston speed.

In the case of the valve means in principle a wide variety of designs are possible, for example in the form of a five way valve or a four way valve. It is more particularly advantageous however to have a design with three way valves.

In the following the invention will be described with reference to the accompanying drawings.

DETAILED DESCRIPTION OF THE PREFERRED EMBODIMENTS

Figure 1:
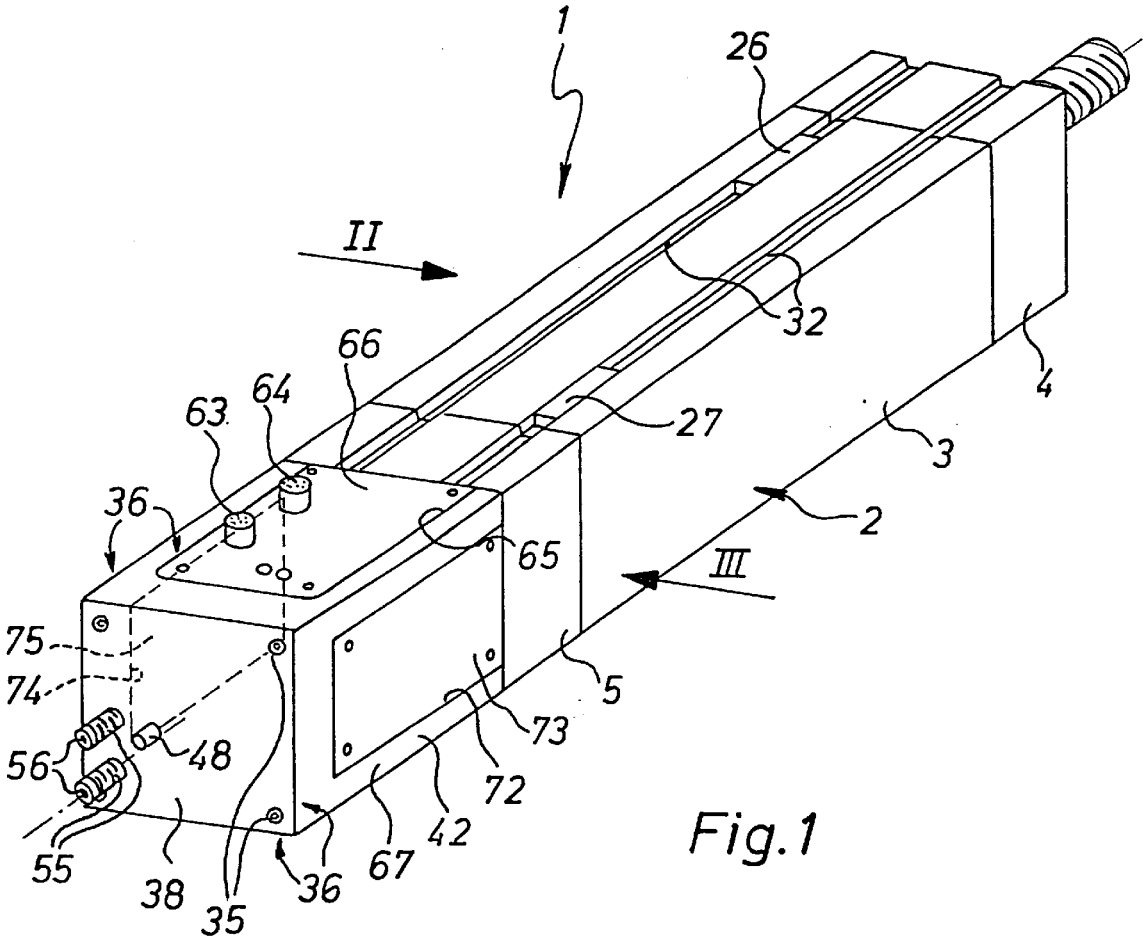
FIG. 1 shows a first design of the fluid power cylinder in accordance with the invention in a perspective elevation looking toward the rear side.
Figure 2:
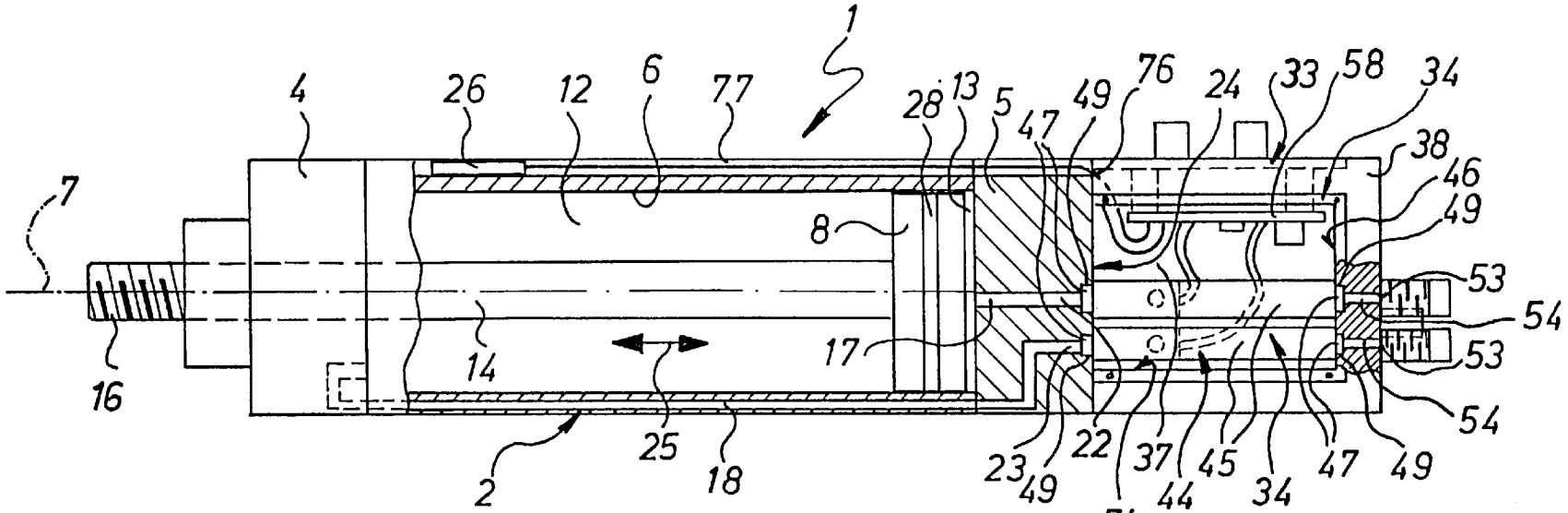
FIG. 2 is a side elevation of the fluid power cylinder looking in the direction of the arrow II in FIG. 1, partly broken away.
Figure 3:
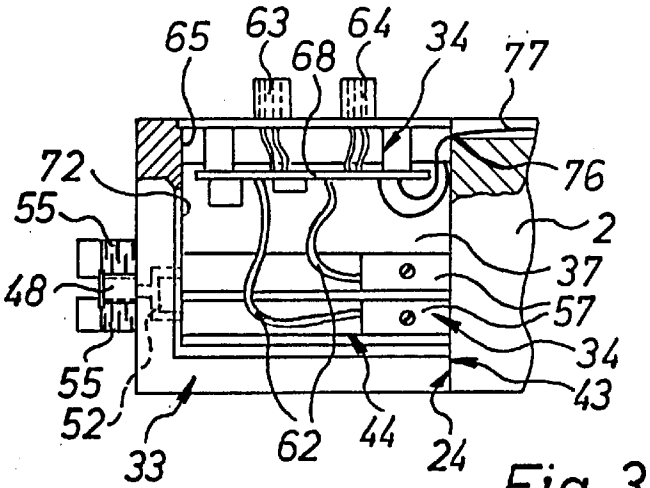
FIG. 3 shows the rear end section, fitted with the control system housing, of the fluid power cylinder in a lateral elevation looking in the direction of the arrow II in figure, again partly broken away.

The fluid power cylinder 1 illustrated in the drawing could in principle be operated hydraulically, but however is more particularly suitable for compressed air operation so that the following description is related to a design in the form of a pneumatic cylinder.

The fluid power cylinder 1 possesses an elongated cylinder housing 2, which is composed of a cylinder tube 3 and furthermore a front and a rear housing cover 4 and 5. The housing covers 4 and 5 are mounted on the front and rear end face of the cylinder tube 3 and secured by attachment, not illustrated in detail, for example using screws or by ties.

The cylinder housing 2 defines a piston receiving space 6 extending in the interior in the longitudinal direction. This piston receiving space extends between the two end faces of the cylinder tube 3 and is closed at the ends by the housing covers 4 and 5.

A piston 8, which is able to be slid in the direction of the longitudinal axis 7 of the cylinder housing 2, is located in the piston receiving space 6 and is provided with sealing means (not illustrated in detail) so that it divides up the piston receiving space 6 into a front working space 12 adjacent to the front housing cover 4, and a rear working space 13 adjacent to the rear housing cover 5 in a fluid-tight fashion.

A piston rod 14 permanently connected with the piston 8 extends from the piston 8 coaxially right through the front working space 12 to then extend through a cover opening formed therein to the outside. The front end section 16 opposite to the piston 8 of the piston rod 14 accordingly lies outside the cylinder housing 2 and to the fore of the front housing cover 4. It is provided with attachment means, as for example a screw thread, which permit attachment to some object to be moved.

In the wall of the cylinder housing 2 a first and a second control duct 17 and 18 extend, which are fluid ducts. The first control duct 17 opens into the front working space 12 and the second control duct 18 into the rear working space 13.

Both control ducts 17 and 18 open at their end opposite to the respective working space at a first and a second control duct connection opening 22 and 23 for access to the rear end face 24 remote from the cylinder tube 2, of the control system housing 2 in the case of which it is simultaneously a question of the correspondingly aligned end face of the rear housing cover 5.

The first control duct 17 only extends through the rear housing cover 5. The second control duct 18 runs right through the rear housing cover 5, extends further in the wall, surrounding the piston receiving space 6, of the cylinder tube 3 and finally merges with the front housing cover 4, by way of it opens into the front working space 12. The openings of the control ducts 17 and 18 into the associated working space 12 and 13 are located preferably at the end face, facing the piston receiving space 6, of the respective housing cover 4 and 5.

By way of the control ducts 17 and 18 the actuating fluid employed for operation of the fluid power cylinder 1, as for example compressed air, may be supplied and leave. In accordance with the resulting fluid actuation of the working spaces 12 and 14 and of the piston 8 dividing same from one another, there is a linear movement of the piston 8 together with the piston rod 14, in the one or the other direction along the longitudinal axis 7. The linear motion is indicated by double a arrow 25.

At the surrounding face of the cylinder housing 2 first and second sensor means 26 and 27 are provided, which serve for detecting the position of the piston 8. In the working embodiment illustrated the sensor means 26 and 27 are switches operated without making physical contact, which are responsive to a magnetic field. This magnetic field is provided ba a permanent magnet means 28, preferably in the form of an annular magnet, arranged on the piston 8, such means 28 moving together with the piston 8 and causing an actuation of the sensor means 26 and 27, when same are generally opposite it.

In order not to obstruct the magnetic field the cylinder tube 3 and preferably the entire cylinder housing 2 consist of material permeable to a magnetic field and more particularly aluminum material.

The sensor means 26 and 27 are received in groove-like longitudinal recesses in the outer periphery of the cylinder housing 2 and extending in the longitudinal direction thereof. In the following such grooves will be referred to as sensor grooves 32.

The sensor grooves 32 preferably extend along the full length of the cylinder housing 2 and open at the end on either side. The sensor means 26 and 27 are preferably located completely clear of the sensor grooves 32 and accordingly do not project past the outline of the cylinder housing 2.

The sensor means 26 and 27 are adjustable in the axial direction and are able to be fixed steplessly at any desired longitudinal position in the sensor grooves 32 in order to be able to detect any desired position of the piston. As a rule the first sensor means 26 will be in the rear end part of the cylinder tube 3 and the second sensor means 27 will be in the rear end part of the cylinder tube 3 so that they are responsive to both possible end positions of the piston 8.

To the rear on the cylinder housing 2 a separate housing is mounted which will be termed a control system housing 33, because it contains control components 34 cooperating in the control of fluid actuation of the piston 8. The control system housing 33 is mounted on the rear end face 24 of the cylinder housing 2 and for example held in position by means of a screw connection on the cylinder housing 2. In order to produce the screw connection in the working example several attachment screws 35 are provided, which extend through the control system housing 33 and are screwed onto suitable threaded holes in the cylinder housing 2.

The external form of the control system housing 33 is preferably so selected that its outline as seen in cross section does not extend past the outline of the axially adjoining cylinder housing 2. The laterally directed outer faces of the cylinder housing 2 merge, more particularly in a flush manner, with the correspondingly aligned side faces of the control system housing 33. This means that for its full length the fluid power cylinder has a uniform slim outline.

Although a cylindrical form would be certainly be possible, it is preferred to have configuration as in the working example, in the case of which the cylinder housing 2 and the control system housing have substantially the same rectangular outlines. Here the optimum is the square cross sectional configuration as illustrated. Like the cylinder housing 2 the control system housing 33 thus has in all four outer faces 36 on different sides.

The control system housing 33 is hollow in design and defines in the interior an inner housing space 37, in which all the above mentioned control components 34 are accommodated.

Preferably the control system housing is pot-like in design and has a floor 38 and a side wall 42 extending away from the it. The housing's inner space 37 is at one end delimited by the floor 38 and at the periphery is delimited by the side wall 42. At the longitudinal side opposite to the floor 38 the control system housing 33 is shown without the walls so that the inner space 37 of the housing is open at this position. Nevertheless the housing's inner space 37 is enclosed on all sides, since the control system housing 33 is mounted with the open side, which is opposite to the floor 38, to the fore on the rear end face 24 of the cylinder housing 2. The control system housing 33 is in engagement with the edge face 43, axially opposite to the floor 38, of the side wall 42 on the cylinder housing 2 or, respectively, the rear housing cover 5. In order to have a sufficient sealing effect a seal, not illustrated, may be fitted in between.

Among the control components 34 accommodated in the housing's interior space 37 there is an electrically actuated valve means 44. Same comprises in the working example two control valves 45 with a 3/2 way valve function. Respectively each of these control valves 45 is responsible for controlling fluid each in one of the working spaces 12 and 13. However, it would be possible to have merely one control valve instead of two control valves, as for example a four way valve or a five way valve. Then using only one single control valve fluid in both of the two working spaces 12 and 13 could be controlled.

The valve means 44 is characterized by only involving particularly simple fitting operations, since it is held between the rear end face 24 of the cylinder housing 2 and the inner face 46, which faces it, provided on the inner side of the floor 38, of the control system housing 33. Here the valve means 44 straddles the housing's inner space 37 lying between these faces 24 and 46.

On the two end sides each control valve 45 is provided with at least one plug dowel 47, which fits into the complementary holding openings 49 in the respective face 24 and 46.

If now the valve means 34 is not to extend along the full overall length of the housing's inner space 37, the housing's inner face 46 serving as a support may also be provided at some other position than the floor 38 in the housing's inner space 37.

Fluid connection means 48 are provided externally on the control system housing 33 for the supply of the actuating fluid. In the working embodiment they are constituted by one connection means, which preferably is in the form of a plug connection means and allows the detachable connection of a fluid line coming from a source of pressure.

The fluid connection means 48 are preferably seated on the rear side, facing away from the cylinder housing 2, of the control system housing 33 and accordingly externally on the floor 38.

The fluid connection means 48 communicate with a fluid duct arrangement 52 extending in the wall of the control system housing 33, such fluid duct arrangement being connected with the valve means 44. In the working embodiment the fluid duct arrangement 52 is so branched that actuating fluid supplied by way of fluid connection means 48 is fed to both control valves 45.

On the rear side of the control system housing 33 venting openings 53 are furthermore provided, which are also connected fluidwise with the valve means 44 by way of venting ducts 54 extending in the wall of the control system housing. Each venting opening 53 communicates in the working example with one of the two control valves 45.

The valve means 44 or, respectively, its control valves 45 are connected with the right association with the control ducts 17 and 18, the fluid duct arrangement 52 and the venting ducts 54. This is ensured preferably at the plug dowels 47, which are engaged with each other, and the holding openings 49. For this purpose the openings of the ducts extending in the cylinder housing 2 and, respectively, in the control system housing 33 are made wider with the formation of the holding openings 49 and the associated valve ducts open at the plug dowels 47.

By means of the fluid connection produced in this manner it is possible to vent the working spaces 12 and 13 or to fill them with compressed air by appropriate operation of the valve means 44. The vented air leaves by way of the venting openings 43, there being the possibility of letting off the spent air jointly in fluid ducts. In the working embodiment however there is the provision of venting directly into the atmosphere around the fluid power cylinder 1, each venting opening 53 being provided with a muffler 55 to reduce the noise of the discharging air, such muffler being provided with an integral spent air choke means 56 if desired in order to influence the speed of the piston 8.

The valve means 44 is designed for electrical operation, each control valve 45 being provided with at least one electrically activated valve drive 57. The valve drive 57 may for instance be in the form of an electromagnet or piezoelectric means.

The valve drives 57 receive their actuating signals, which predetermine their switching state, from electronic control circuitry 58, which is included as one of the above mentioned control components 34 accommodated in the housing's inner space 37. Suitable first electrical signal lines 62 make the electrical connection.

The electronic control circuitry 58 is provided with field bus electronic circuitry, not illustrated in detail, which communicates with electrical connection means 63 provided on the control system housing 33 and which serve for the supply of electrical control signals. For this purpose an electrical signal connection may be created with the electrical connection means 63 by way of a bus line to provide a connection with an external electronic control means, which supplies the control signals of the fluid power cylinders, which are passed on by the electronic control circuitry 58 to the valve drives 57 with the desired coordination. The electrical connection means 63 are for this purpose designed in the form of field bus connection means.

In addition to the electronic control circuitry 58 it is also possible for valve electronic circuitry (not illustrated) to be present, which sets and/or influences certain parameters of valve actuation. The valve electronic circuitry may also be designed in the form of a component of the electronic control circuitry.

To the extent that separate supply of the drive power is desired, it is possible furthermore for further electrical connection means 64 to be provide externally on the control system housing 33, such connection means being suitably designed for this purpose.

The electronic valve circuitry and/or electronic control circuitry 58 is characterized by good accessibility, something which considerable facilitates assembly and also any servicing operations which may be needed. It is namely located in the interior of the control system housing 33 near a first access opening 65 of the control system housing 33, which normally is closed by a detachably mounted first housing cover 66. After the removal of the first housing cover 66 from the principal body still remaining from the cylinder housing 2 the electronic valve circuitry and/or electronic control circuitry 58 is accessible.

In principle this could be ensured by any mounting of the electronic valve circuitry and/or electronic control circuitry 58 on the principal body adjacent to the first access opening 65. Preferably however one further step is taken and the electronic valve circuitry and/or electronic control circuitry is mounted on the inner side of the first housing cover 66, which accordingly constitutes a support for the electronic valve circuitry and/or electronic control circuitry 58, such support being solely responsible for fixing such electronic circuitry in position. For this purpose the electronic valve circuitry and/or electronic control circuitry 58 may as illustrated be provided on a printed circuit board on the inner side of the first housing cover 66, preferably by means of spacers.

If the housing cover 66 is removed and turned over the electronic circuitry 58 is completely accessible.

A further second access opening 72 in the principal body 67 of the is arranged on another lateral outer face 36 and is closed by a second housing cover 73 in a detachable manner. In this case the arrangement is such that the second access opening 72 is opposite to the electrical drive means 57 of the valve means 44 and accordingly on removal of the second housing cover 73 such electrical drive means or, respectively, valve drives 57 become readily accessible from the outside for connection purposes.

Preferably the second access opening 72 is provided on a lateral outer face 36, which is directly adjacent to the one at which the first access opening 65 is located.

A further third access opening 74 with an associated third housing cover 75 is located on the lateral outer face 36 opposite to the second access opening 72. It renders possible direct access to the valve means 44.

Owing to the arrangement of the access openings 65, 72 and 74 around the periphery of the control system housing 33 optimum access in the housing's inner space 37 is possible. In the insert of the fluid power cylinder 1 the access openings are sealed off by the above mentioned housing covers so that entry of dirt is prevented. The attachment of the housing covers may for example be ensured by screw or catch means.

In the direction toward the cylinder housing 2 the access openings 65 are not delimited by the principal body 67 of the control system housing 33. Such delimitation is in fact ensured by the rear end face 24 of the cylinder housing 2. The result of this is the advantage that the sensor grooves 32 open at the rear end face 24 at positions, which are adjacent to an access opening, that is to say more particularly adjacent to the first access opening 65 associated with the electrical circuitry 58. Because the depth of same is selected to be larger than the thickness of the first housing cover 66 closing the first access opening, a respective slot-like opening 76 remains in the transitional zone between the cylinder housing 2 and the control system housing 33 and through such opening sensor signal lines 77, coming from the sensor means 26 and 27, enter the housing's inner space 37. Between a respective opening 76 and the associated sensor means 26 and 27 the sensor signal lines 77 extend, which are more particularly constituted by cables, so that same do project beyond the outline of the cylinder housing. It is also possible to mount additional covers in the sensor grooves 32 in this part for the sensor signal lines 77 (not illustrated).

In the housing's inner space 37 the sensor signal lines 77 are connected with the electronic control circuitry 58, putting same in the position of being able to process incoming sensor signals and to take them into account for the drive of the valve means 44.

If the control system housing 33 does not comprise a separate electronic control circuitry and it is only provided with plain electronic valve control circuitry the sensor signal lines 77 are preferably in contact with the electrical connection means 63 with the result that the sensor signals are passed on to external electrical equipment. This is in principle possible even when the control system housing 33 is provided with electronic control circuitry 58.

What is claimed is:

1. A fluid power cylinder comprising:

a cylinder housing containing therein a piston receiving space in which a piston able to be moved by fluid actuation is arranged, which is kinematically coupled with a piston rod extending out at the front end of the cylinder housing, a control system housing mounted on the rear end of the cylinder housing, the system housing contains control components cooperating for control of fluid actuation of the piston, the control components including an electrically actuated valve means and furthermore electronic valve circuitry and/or electronic control circuitry cooperating in the electrical control of the valve means, the side of the control system housing has a plurality of access openings arranged about the periphery and closed by detachable housing covers, one opening being opposite to an electrical drive means of the valve means and a further access opening being arranged adjacent to the electronic valve circuitry and/or electronic control circuitry, electrical connection means provided externally on the control system housing for the supply of electrical control signals, which electrical connection means are connected in the control housing with electronic valve circuitry and/or electronic control circuitry, and fluid connection means provided externally on the control system housing for the supply of an actuating fluid, the electrical connection means are connected with the valve means, whence control ducts emerge, which extend in the wall of the cylinder housing to the piston receiving space.

2. The fluid power cylinder as set forth in claim 1, characterized in that the outline of the control system housing does not project past the outline of the axially adjoining cylinder housing.

3. The fluid power cylinder as set forth in claim 1, characterized in that the cylinder housing and the control system housing possess essentially similar rectangular outlines.

4. The fluid power cylinder as set forth in claim 1, characterized in that on the cylinder housing sensor means are provided in the peripheral part of the piston receiving space for detecting the position of the piston, and electrical sensor signal lines extend from such sensor means and into the control system housing.

5. The fluid power cylinder as set forth in claim 4, characterized in that the sensor means and the sensor signal lines are accommodated in sensor grooves provided on the outer periphery of the cylinder housing.

6. The fluid power cylinder as set forth in claim 4, characterized in that the electrical sensor signal lines extend in the transition zone between the cylinder housing and the control system housing through an opening turned toward the cylinder housing, into the interior space in the control system housing.

7. The fluid power cylinder as set forth in claim 4, characterized in that the sensor signal lines are connected in the interior of the control system housing with the electronic valve circuitry and/or electronic control circuitry or directly with the electrical connection means.

8. The fluid power cylinder as set forth in claim 1, characterized in that the control system housing has at least one laterally placed access opening, which is sealed off by a removable housing cover.

9. The fluid power cylinder as set forth in claim 8, characterized in that a housing cover constitutes a support for the electronic valve circuitry and/or electronic control circuitry arranged on the inner side of the support.

10. The fluid power cylinder as set forth in claim 9, characterized in that the electronic valve circuitry and/or electronic control circuitry is provided on a printed circuit board with electronic circuitry mounted on the inner side of the respective housing cover.

11. The fluid power cylinder as set forth in claim 1, characterized in that the electronic control circuitry comprises a field bus electronic system.

12. The fluid power cylinder as set forth in claim 1, characterized in that the electrical connection means on the control system housing are in the form of a field bus connection.

13. The fluid power cylinder as set forth in claim 1, characterized in that the control system housing is pot-like and has a floor and a side wall and with the open side, opposite to the floor to the fore, is mounted on the rear side of the cylinder housing.

14. The fluid power cylinder as set forth in claim 1, characterized in that the valve means extend between the rear end face of the cylinder housing and an inner face of the housing, opposite to such end face, of the control system housing and is held on such faces.

15. The fluid power cylinder as set forth in claim 14, characterized in that the valve means possesses plug dowels, which are fitted in holding openings in the rear end face (of the cylinder housing and in the housing's inner face facing same, in the control system housing in an interlocking manner.

16. The fluid power cylinder as set forth in claim 14, characterized in that the housing's inner face is constituted by the inner face of the floor of the pot-like control system housing.

17. The fluid power cylinder as set forth in claim 1, characterized in that the fluid connection means are provided on the rear side, facing away from the cylinder housing of the control system housing.

18. The fluid power cylinder as set forth in claim 1, characterized by a design in the form of a pneumatic fluid power cylinder, in the case of which all venting openings are provided at the rear side, facing away from the cylinder housing of the control system housing.

19. The fluid power cylinder as set forth in claim 18, characterized in that each venting opening is fitted with a muffler.

20. The fluid power cylinder as set forth in claim 1, characterized in that the valve means comprises a four way valve or a five way valve or two three way valves.

21. A fluid power fluid cylinder comprising:

a cylinder housing containing therein a piston receiving space in which a piston able to be moved by fluid actuation is arranged, the piston is kinematically coupled with a piston rod extending out at the front end of the cylinder housing, a control system housing mounted on the rear end of the cylinder housing, the system housing contains control components cooperating for control of fluid actuation of the piston, the control components including an electrically actuated valve means and electronic valve circuitry and/or electronic control circuitry cooperating in the electrical control of the valve means, the valve means extends between a rear end face of the cylinder housing and an inner face of the housing, opposite to such end face, of the control system housing and is held on such faces, electrical connection means provided externally on the control system housing for the supply of electrical control signals, which electrical connection means are connected in the control housing with electronic valve circuitry and/or electronic control circuitry, and fluid connection means provided externally on the control system housing for the supply of an actuating fluid, the electrical connection means are connected with the valve means, whence control ducts emerge, which extend in the wall of the cylinder housing to the piston receiving space.

22. The fluid power cylinder as set forth in claim 21, wherein the valve means possesses plug dowels, which are fitted in holding openings in the rear end face of the cylinder housing and in the housing's inner face facing same, in the control system housing in an interlocking manner.

23. The fluid power cylinder as set forth in claim wherein the housing's inner face is constituted by the inner face of the floor of the pot-like control system housing.

* * * * *

UNITED STATES PATENT AND TRADEMARK OFFICE

CERTIFICATE OF CORRECTION

PATENT NO. : 6,755,115 B2
DATED : July 19, 2004
INVENTOR(S) : Stoll et al.

It is certified that error appears in the above-identified patent and that said Letters Patent is hereby corrected as shown below:

Column 12,
Line 4, now reads "in claim wherein…", and should read -- in claim 21, wherein… --.

Signed and Sealed this

Thirty-first Day of August, 2004

JON W. DUDAS
*Director of the United States Patent and Trademark Office*